US007141783B2

(12) United States Patent
Kim et al.

(10) Patent No.: US 7,141,783 B2
(45) **Date of Patent: *Nov. 28, 2006**

(54) APPARATUS FOR FOCUSING PARTICLE BEAM USING RADIATION PRESSURE

(75) Inventors: Sang Soo Kim, Seoul (KR); Hyung Ho Park, Daejeon (KR); Sang Bok Kim, Busan (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 209 days.

This patent is subject to a terminal disclaimer.

(21) Appl. No.: 10/976,095

(22) Filed: Oct. 27, 2004

(65) Prior Publication Data

US 2006/0011872 A1 Jan. 19, 2006

(30) Foreign Application Priority Data

Jul. 7, 2004 (KR) ..... 10-2004-0052670

(51) Int. Cl.
*H01J 41/04* (2006.01)

(52) U.S. Cl. ..... 250/251

(58) Field of Classification Search ..... 250/251
See application file for complete search history.

(56) References Cited

U.S. PATENT DOCUMENTS

| | | | | |
|---|---|---|---|---|
| 3,808,432 | A * | 4/1974 | Ashkin | 250/251 |
| 5,495,105 | A * | 2/1996 | Nishimura et al. | 250/251 |
| 6,348,687 | B1 | 2/2002 | Brockmann et al. | |
| 6,636,676 | B1 * | 10/2003 | Renn | 385/125 |
| 6,995,351 | B1 * | 2/2006 | Curtis et al. | 250/222.2 |

* cited by examiner

*Primary Examiner*—David A. Vanore
(74) *Attorney, Agent, or Firm*—McCarter & English, LLP

(57) ABSTRACT

The present invention relates to an apparatus for focusing particle beams using a radiation pressure capable of obtaining the same flow amount and a narrower particle beam width with respect to the particle size and a higher numeral density. It is possible to form the particle beams by applying the radiation pressure to the particles with respect to the flow condition that cannot form the particle beams with respect to the set particle sizes. There is provided an apparatus for focusing particle beams using a radiation pressure, comprising an orifice part that is provided at a predetermined portion of the flow tube, and a lens having a hole with a predetermined diameter for thereby focusing the particle flow into a particle beam and applying a radiation pressure to the flow particles; and a light source supply part (A) provided at a portion opposite to the discharge outlet of the mixing tube.

11 Claims, 6 Drawing Sheets

APPARATUS FOR FOCUSING PARTICLE BEAM USING RADIATION PRESSURE

BACKGROUND OF THE INVENTION

1. Field of the Invention

The present invention relates to, an apparatus for focusing a particle beam, and in particular to an apparatus for focusing a particle beam using a radiation pressure capable of controlling the width of a particle beam 2. Description of the Background Art A particle beam represents that the flow of a particle has a beam type. In the case that particles flow in a beam type narrow region, the number concentration of particles is increased, so that it is possible to monitor particles with high accuracy. In addition, since the particles continuously flow in a beam type, it is possible to measure the sizes of particles and a particle size distribution in real time. Therefore, a particle beam focusing apparatus has been used for a mass analyzer or a chemical composition analyzer. Recently, it has been used in a micro particle monitoring apparatus in which particles rarely exist like in a semiconductor process.

In the conventional art, a particle beam focusing apparatus has been generally used as an apparatus for generating particle beams wherein an aerodynamic lens is used therein. In the particle beam focusing apparatus using an aerodynamic lens, a particle flows but of an airflow way using an inertia effect of particles while air-particle flow passes through an orifice. The above particle beam focusing apparatus has an advantage in that it is possible to easily generate particle beans.

FIG. 1 is a view illustrating a conventional particle beam apparatus using an aerodynamic lens, and FIG. 2 is a view illustrating an air-particle flow in an orifice part of FIG. 1. As shown in FIG. 1, in a particle beam focusing apparatus using an aerodynamic lens, there are provided a particle generator 7, an air-particle mixing tube 1, a flow tube 2 that is provided at one side of the mixing tube 1 for thereby guiding air-particle to flow along a straight line, and an orifice part 3 that is provided at a predetermined portion of the flow tube 2 wherein the orifice part 3 has a hole 31 with a certain diameter and is formed in a flat plate shape.

In addition, as shown in FIG. 2, the particles from the particle generator 7 are supplied to the mixing tube 1. The air-particle mixed with the air in the mixing tube 1 is discharged through the flow tube 2. The air-particle flow discharged from the mixing tube 1 passes through the orifice part 3, and the particles are collected at the center from the flow of the air by an inertia force, so that the air-particle flow is formed in a form of particle beam. A contraction factor $\eta$ representing a particle beam formation performance has been generally used. Here, the contraction factor $\eta$ may be expressed in such a manner that a ratio ($\eta=\gamma_p(\infty)/\gamma_o(\infty)$) of the radius ($\gamma_p$) direction position of an outer most particle trace with respect to the radius ($\gamma_o$) direction position of the air outer most streamline is expressed after the air-particle flow passes through the orifice part 3. In the case that the contraction factor is 0, it represents that particles are collected at the center axis, and in the case that the contraction factor is 1, it represents that the particles flow along the air flow way. In the case that the contraction factor is a negative number, it means that the particles cross the center axis. Therefore, in the case that the particle beam is formed, the contraction factor has a value of $-1<\eta<1$.

However, in the case that the particle beam apparatus using the aerodynamic lens is adapted, the width of the particle beam that can be obtained under the set flow condition and the size of available particles are limited. In addition, on the contrary, there are disadvantages that the width of the particle beam that can be obtained with respect to the set size of the particle and the available flow amount are limited. Namely, it is needed to change the design of the particle beam apparatus. As one example, a certain research has been conducted for decreasing the width of the particle beam using a multistage type aerodynamic lens having a plurality of orifices. In the case that the multistage type aerodynamic lens is used, the particle beam apparatus gets complicated, and the disadvantages in the operation particle size and the flow condition of the aerodynamic lens still remain.

SUMMARY OF THE INVENTION

Accordingly, it is an object of the present invention to provide an apparatus for focusing particle beams using a radiation pressure capable of overcoming the problems encountered in the conventional art.

It is another object of the present invention to provide an apparatus for focusing particle beams using a radiation pressure capable of obtaining a narrower particle beam width as compared to the same flow amount condition and a particle size. As a result, it is possible to obtain the increased number concentration of particles.

It is further another object of the present invention to provide an apparatus for focusing particle beams using a radiation pressure capable of forming particle beams in such a manner that a radiation pressure is applied under the flow condition in which particle beams can not be formed with respect to the size of particle.

It is still further another object of the present invention to provide an apparatus for focusing particles beams using a radiation pressure forming particles beams in such a manner that particle beams are formed with respect to the size of particle wherein the particle beams can not be formed with respect to the set flow condition.

To achieve the above objects, in an apparatus for focusing a particle beam that includes a particle generator, a mixing tube connected with the particle generator, and a flow tube coupled with a discharge outlet of the mixing tube, there is provided an apparatus for focusing particle beams using a radiation pressure, comprising an orifice part that is provided at a predetermined portion of the flow tube, and a optical lens having a hole with a certain diameter for thereby focusing the particle flow into a particle beam and applying a radiation pressure to the flow particles; and a light source supply part (A) provided at a portion opposite to the discharge outlet of the mixing tube.

The orifice part of the particle beam focusing apparatus using the radiation pressure according to the present invention is formed of a plane-convex lens having a hole with a predetermined diameter at the center of the same.

The orifice part of the particle beam focusing apparatus using the radiation pressure according to the present invention is formed of a transparent material.

In addition, the light source supply part of the particle beam focusing apparatus using the radiation pressure according to the present invention includes an Ar-Ion laser, at least two reflection mirrors and two laser beam magnifying lenses capable of magnifying the laser beam.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
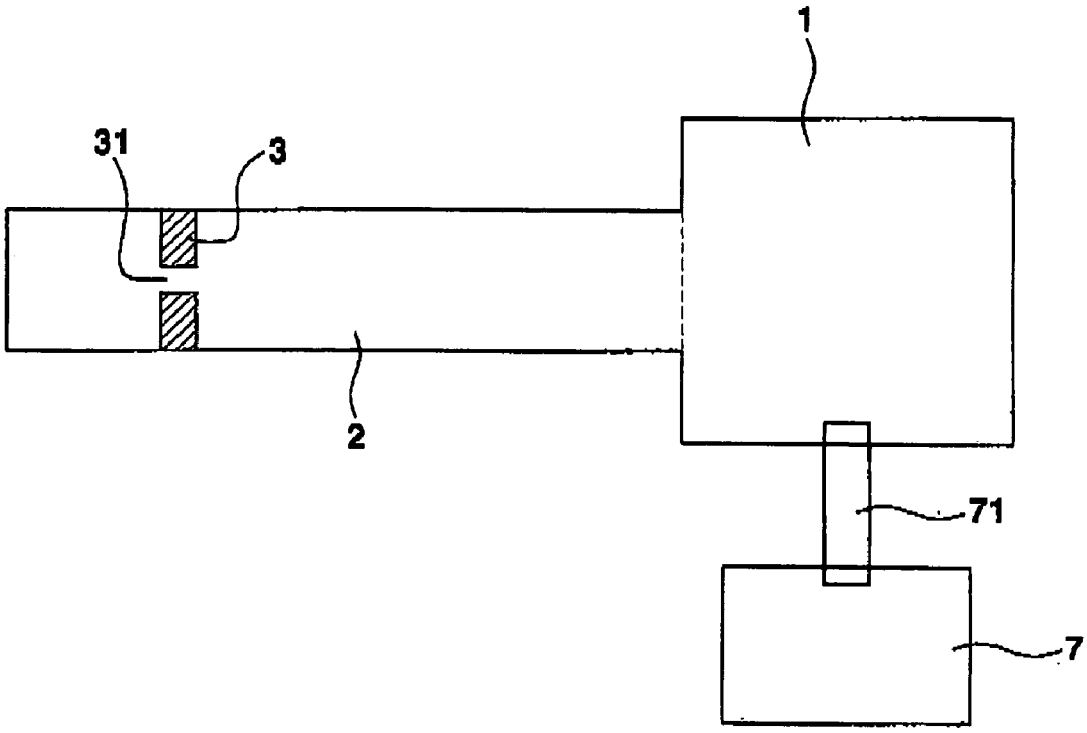
FIG. 1 is a schematic view illustrating a conventional particle beam apparatus using an aerodynamic lens.
Figure 2:
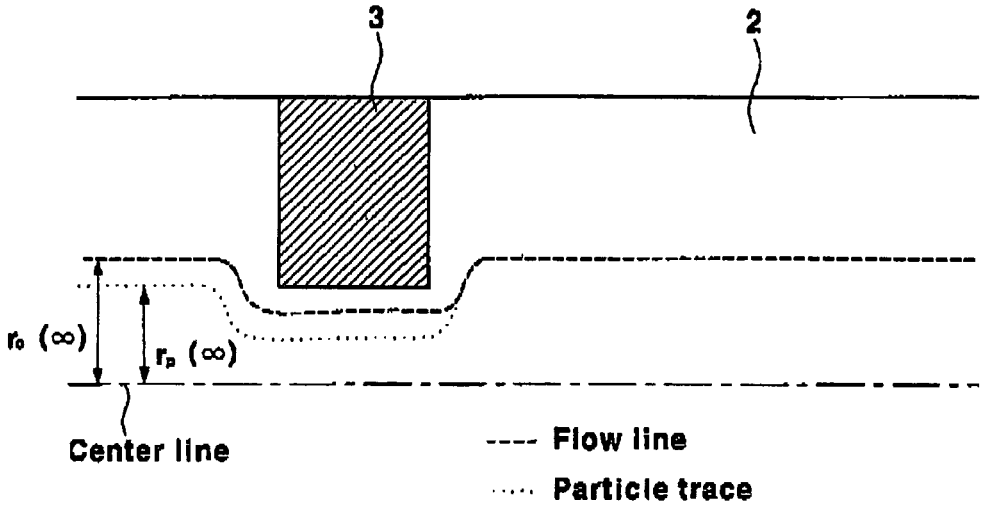
FIG. 2 is a schematic view illustrating an air-particle flow in the orifice part of FIG. 1.
Figure 3:
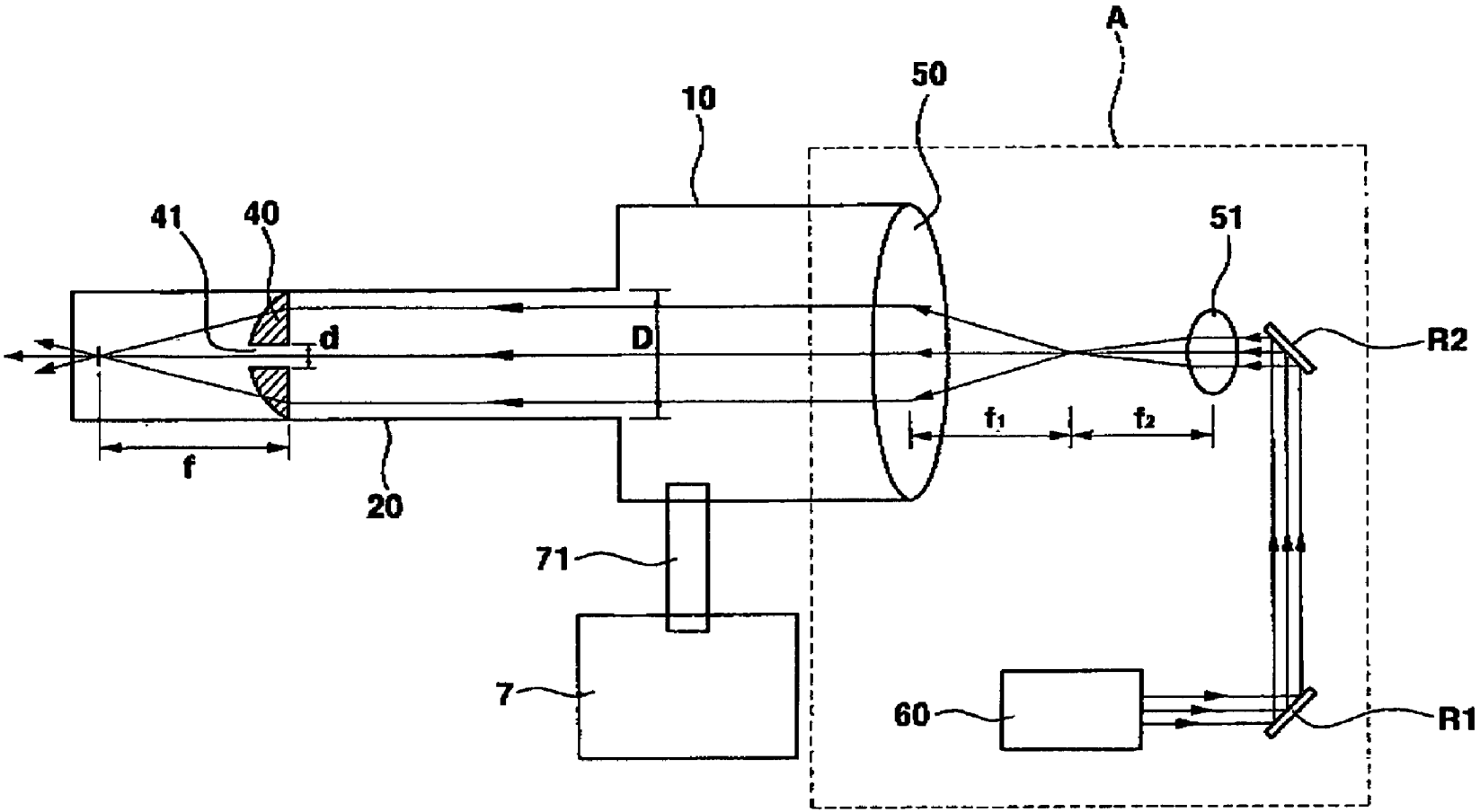
FIG. 3 is a schematic view illustrating a particle beam focusing apparatus using a radiation pressure according to the present invention.

FIG. 3 is a schematic view illustrating a particle beam focusing apparatus using a radiation pressure according to the present invention. As shown therein, the particle beam focusing apparatus using a radiation pressure according to the present invention includes a particle generator 7, a mixing tube 10, a flow tube 20, an orifice part 40 and a light source supply part (A).

The particle generator 7 is formed in a certain shape having an ejecting part 71 at one side of the same and is connected through the ejecting part 71 at one side of the mixing tube 10.

Here, the mixing tube 10 is formed in a cylindrical shape, and the flow tube 20 is connected at one end of the same, and the light source supply part (A) is provided at the other end of the same. In addition, the particle generator 7 is connected with one side of the mixing tube 10.

The flow tube 20 is formed in an elongated cylinder having a cross section of a predetermined diameter (D) of which both end sides are opened, and one end of the same is connected with the mixing tube 10.

A hole 41 having a predetermined diameter (d) is formed at the center of the orifice part 40, and one side surface is formed in plane, and the other side surface is formed in a shape of a plane-convex, lens. The material of the orifice part 40 is formed of a transparent material. The orifice part 40 is provided at an inner side adjacent to the other end of the flow tube 20.

The light source supply part (A) includes a laser beam apparatus 60, a first reflection mirror $R_1$ distanced from a beam outlet side of the laser beam apparatus 60, a second reflection mirror $R_2$ distanced from the first reflection mirror $R_1$ at a certain angle, and a fist lens 50 and a second lends 51 for magnifying the laser beam inputted, through the second reflection mirror $R_2$. Here, the first lens 50 has a curvature larger than the second lens 51. The first lens 50 and the second, lens 51 adapted to supply a parallel light to the flow tube 20 are distanced by a distance sum ($f_1+f_2$) of the focusing distance of each lens.

The first lens 50 is installed at an end of the other side of the mixing tube 10. The laser beam could be an Ar-Ion CW laser, a He—Ne laser and a He—Cd laser that are continuously outputted. In addition, a pulsed Nd-Yag laser may be adapted wherein it is outputted in a pulse type with a short time phase between the outputted pulses.

The operation of the apparatus for focusing particle beams using a radiation pressure according to the present invention will be described with reference to FIGS. 3 through 6.

As shown in FIG. 3, the Ar-Ion laser beam outputted from the laser beam apparatus 80 of the light source supply part (A) is reflected by the first reflection mirror $R_1$ and the second reflection mirror $R_2$ and is focused through the second lens 52 that is a convex lens. The Ar-Ion laser beam is changed to a parallel light through the first lens 50. In the drawing, the proceeding light is indicated by the arrow. The particle supplied from the particle generator 7 is mixed with the air in the mixing tube 10, and the air-particle is flown through the flow tube 20 and passes through the orifice part 40 for thereby forming a particle beam. At this time, the light vertically inputted into the plane lens side of the orifice part 40 formed of the plane-convex lens is focused with a focusing distance (f). As a result, the focused light exerts a certain force by a radiation pressure to the particles passed through the orifice part 40. The force that the radiation pressure can apply to the particles is divided into a scattering force applied in the proceeding direction of light and a gradient force applied in the direction that the intensity of the light is largely applied. The magnitude of the forces is changed based on the diameter of the lens when the light is focused through the lens. Therefore, it is possible to apply the force in the direction needed to the flow particle of the particle beam. In addition, according to well-known equation as below, the relation between a momentum of the light and a force applied to a particle by the light computed by a geometric-optics approximation:

$$F=Q(n_1P)/c$$

Where F represents the force that the particle receives by light, and Q represents a degree that the particle reflects light, and $n_1$ represents reflection index of medium embedded particles, and P represents a laser output energy, and c represents the speed of light.

Namely, it is known that the force that the particle receives by radiation pressure is in proportional to the power of light. Therefore, it is possible to apply the force having a desired size to the flow particle of the particle beam by adjusting the power of light.

EMBODIMENTS

In order to explain the particle beam focusing apparatus using a radiation pressure according to the present invention, there are provided a flow tube having a diameter (D) of 25 mm, and an orifice part 40 having a hole diameter (d) of 2.5 mm and a focusing distance (f) of 35 mm of the lens. The particles adapted are PSL, and the diameters of the particles are 0.5 μm, 1.0 μm, and 2.5 μm. The laser adapted in the laser beam apparatus 60 is a Ar—Ion CW laser. The output of the Ar—Ion CW laser having the minimum value of the particle beam width when the radiation pressure is applied using the laser with respect to the size of the particle adapted is about 0.2 W. In the orifice part 40, the Reynolds number (Re) maintains about 300~700 so that the particle beams can be formed at the atmospheric pressure based on the air-particle flow amount. Here, the Reynolds number may be expressed like the following.

$$Re(\text{Reynolds number})=\rho Vd/\mu$$

Here, ρ represents the density of the air, and V represents the mean speed at the orifice part 40, and μ represents the viscosity of the air, and d represents the diameter of the hole 41 of the orifice part 40.

In addition, the width ($d_b$) of the particle beam is measured at a position distanced from the orifice part 40 by 45 mm.

Figure 4:
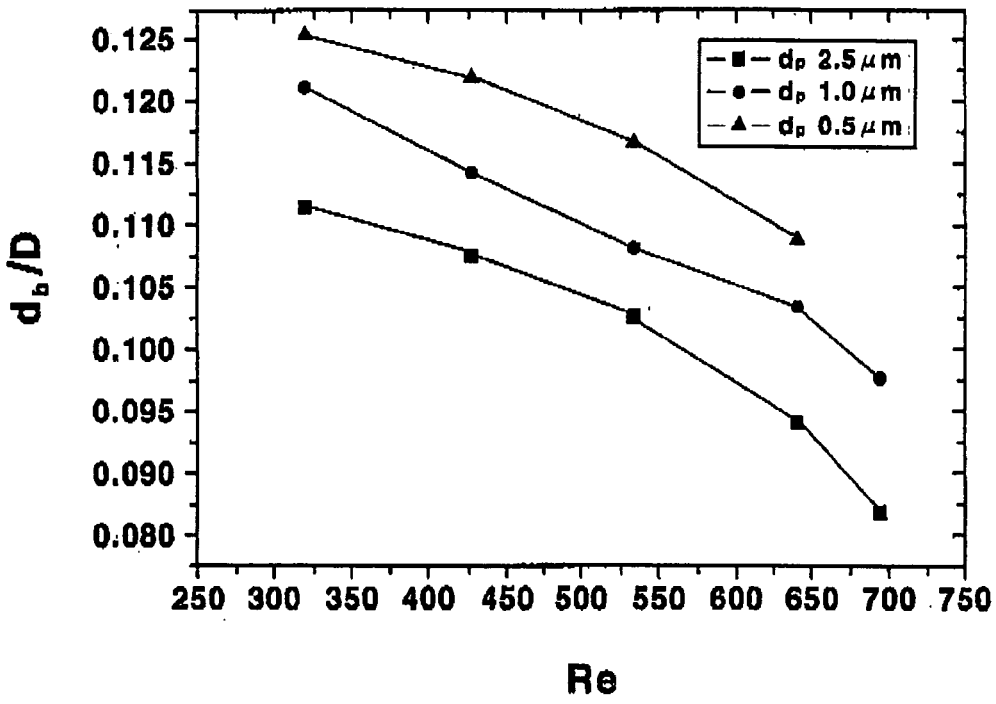
FIG. 4 is a graph of a width of a particle beam measured based on the Reynolds number in the case that a radiation pressure is not applied.

FIG. 4 is a graph of the width ($d_b$) of a particle beam measured based on the Reynolds (Re). Here, the horizontal axis (X-axis) represents the Reynolds number (Re), and the vertical axis (Y-axis) represents the ratio between the width ($d_b$) of the measured particle beam and the diameter D of the flow tube 20.

As shown in FIG. 4, the diameters of the PSL particles used are 0.5 μm, 1.0 μm and 2.5 μm, and the width ($d_b$) of the particle beam is getting smaller when the Reynolds (Re) is getting higher, and the diameter ($d_p$) of the particle is getting higher. The above result is the same as the conventional aerodynamic particle beam apparatus. Therefore, even when the orifice part 40 of the plane-convex lens according to the present invention is used instead of the conventional orifice part 40 of the flat plate shape, there are not any effects in the flow condition when the particle beam is formed.

Figure 5:
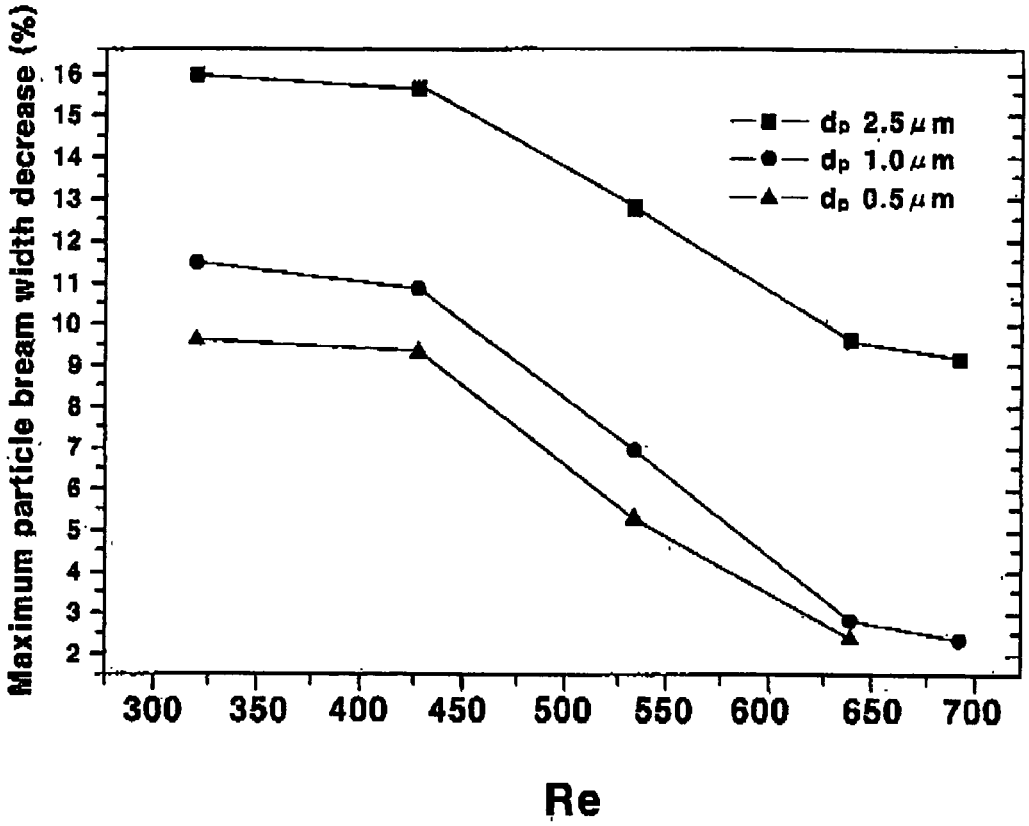
FIG. 5 is a graph of a width decrease ratio of a particle beam measured based on the Reynolds number in the case that a radiation pressure is applied.

FIG. 5 is a graph of the decrease ratio of the width ($d_b$) of the particle beam measured based on the Reynolds number (Re) when the radiation pressure is applied. Here, the horizontal axis (X-axis) represents the Reynolds number (Re), and the vertical axis (Y-axis) represents the decrease ratio ($d_b$) of the maximum particle beam measured. As shown in FIG. 5, the decrease of the width of the particle beam is 16%, 11.4% and 9.6% in maximum with respect to the diameters ($d_p$) of the particle of 2.5 μm, 1.0 μm and 0.5 μm. Here, since the radiation pressure is in proportional to the surface area of the particles, as the particle is larger, the width decrease ratio of the particle beam is large. As the flow amount is getting higher, since the inertia effect of the particle is increased, it is known that the effects of the radiation pressure become less. In addition, in the orifice part 40, as the Reynolds number (Re) is getting higher, since the inertia force of the particles is getting higher, it is known that the effects of the radiation pressure become less.

Figure 6:
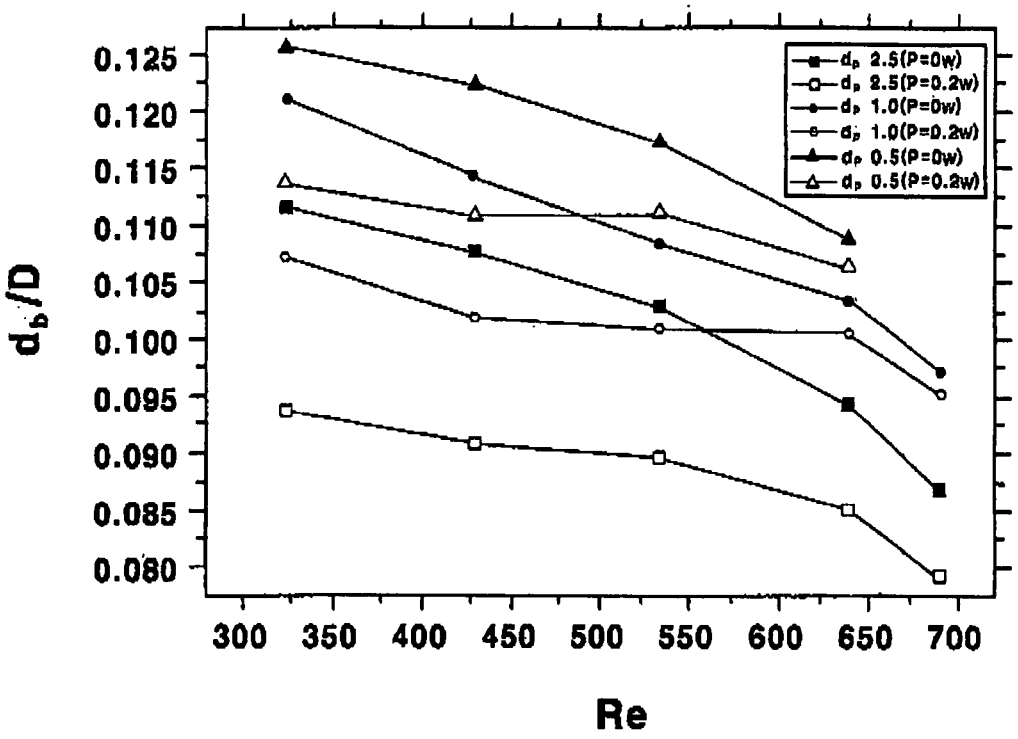
FIG. 6 is a graph of a variation of a width ($d_b$) of a particle beam measured based on the Reynolds number (Re) in the case that a radiation pressure is not applied (P=0 W) and a laser output.

FIG. 6 is a graph concurrently showing the variations of the widths ($d_b$) of the particle beams measured based on the Reynolds number (Re) in the case that there is not a radiation pressure (P=0 W) and the output of the laser is 0.2 W. Here, the horizontal axis (X-axis) represents the Reynolds number (Re), and the vertical axis (Y-axis) represents the ratio value between the width ($d_b$) of the maximum particle beam measured and the diameter D of the flow tube 20. Here, the full line represents the width ($d_b$) of the particle beam of each particle measured based on the Reynolds number (Re) in the orifice part 40 when there is not a radiation pressure (P=0 W). It is the same result as FIG. 4. Here, the dotted line represents the width ($d_b$) of the particle beam of each particle measured based on the Reynolds number (Re) in the orifice part 40 in the case that the radiation pressure is adapted based on the output of the laser. As a result, it is known that the width of the particle beam significantly less than the case that there is not a radiation pressure (P=0 W) is obtained. Therefore, it is impossible to obtain the above effects in the conventional aerodynamic particle beam apparatus. Namely, it represents that it is possible to control the range of the limited width of the particle beam obtained with respect to the size of the set particle using the radiation pressure.

In the present invention, the isotope isolation, particle acceleration and particle floating are obtained using the radiation pressure according to the present invention. The particle beam focusing apparatus could be adapted in the mass analyzer or the chemical composition analyzer. It is possible to use in the micro particle monitoring apparatus under the environment that there are rarely particles like in the semiconductor process.

In the present invention, it is possible to obtain particle beam width smaller than conventional aerodynamic lens system. As a result, numeral particle number concentration can be obtained. It is possible to form the particle beams by applying the radiation pressure with respect to the flow condition under which the particle beam cannot be formed with respect to the set particle size. On the contrary, in the present invention, it is possible to form the particle beams with respect to the sizes of the particles that cannot form the particle beams under the set flow condition.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In an apparatus for focusing a particle beam that includes a particle generator, a mixing tube connected with the particle generator, and a flow tube coupled with a discharge outlet of the mixing tube, an apparatus for focusing particle beams using a radiation pressure, comprising:

an orifice part that is provided at a predetermined portion of the flow tube, and a lens having a hole with a predetermined diameter for thereby focusing the particle flow into a particle beam and applying a radiation pressure to the flow particles; and a light source supply part (A) provided at a portion opposite to the discharge outlet of the mixing tube.

2. The apparatus of claim 1, wherein said orifice part is formed of a plane-convex lens having a hole with a predetermined diameter at the center of the same.

3. The apparatus of claim 2, wherein said orifice part is formed of a transparent material.

4. The apparatus of claim 2, wherein when the cross section diameter (D) of the flow tube is 25 mm, the diameter (d) of the hole of the orifice part is 2.5 mm.

5. The apparatus of claim 4, wherein the focusing distance (f) of the lens of the orifice part is 35 mm.

6. The apparatus of claim 1, wherein said light source supply part (A) includes a laser beam apparatus, and a pair of first and second lenses capable of magnifying the width of the laser beams from the laser beam apparatus.

7. The apparatus of claim 6, wherein said laser beam apparatus uses an Ar—Ion CW laser.

8. The apparatus of claim 6, wherein said first and second lenses are distanced by a distance sum ($f_1+f_2$) of the focusing distances of the same for thereby supplying a parallel light to the flow tube.

9. The apparatus of claim 6, wherein when a radiation pressure is applied to the particle beam, the output energy of the Ar—Ion CW laser beam is about 0.2 W in order to minimize the width of the particle beam.

10. The apparatus of claim 6, wherein said light source supply part (A) further includes at least two reflection mirrows ($R_1$ and $R_2$).

11. The apparatus of claim 1, wherein the Reynolds number (Re) of the particle flow in the orifice part is about 300~700 so that the particle beam can be formed at the atmospheric pressure.

* * * * *